US007532105B2

(12) United States Patent
Cho et al.

(10) Patent No.: US 7,532,105 B2
(45) Date of Patent: May 12, 2009

(54) METHOD FOR PROVIDING ALARM AND MORNING CALL SERVICES IN A DMB TERMINAL

(75) Inventors: Jeong-Sik Cho, Suwon-si (KR); Young-Jip Kim, Suwon-si (KR); Tae-Soo Lee, Seoul (KR); Sun-Mi Kim, Seoul (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 280 days.

(21) Appl. No.: 11/487,858

(22) Filed: Jul. 17, 2006

(65) Prior Publication Data

US 2007/0036035 A1 Feb. 15, 2007

(30) Foreign Application Priority Data

Aug. 10, 2005 (KR) ..... 10-2005-0073369

(51) Int. Cl.
*G08B 1/00* (2006.01)

(52) U.S. Cl. ..... 340/309.16; 340/309.9; 713/500; 368/12

(58) Field of Classification Search ..... 340/309.16, 340/905, 539.1, 5.5, 5.85, 995.21, 995.13, 340/309.9; 713/500, 30, 324; 711/5; 710/62; 368/10, 12, 13

See application file for complete search history.

(56) References Cited

U.S. PATENT DOCUMENTS 5,359,577 A * 10/1994 Hoshino et al. ..... 368/67
6,678,215 B1 * 1/2004 Treyz et al. ..... 368/10
6,940,395 B2 * 9/2005 Steinmark ..... 340/309.16
7,137,023 B2 * 11/2006 Lin et al. ..... 713/500

FOREIGN PATENT DOCUMENTS

KR 2006-27496 3/2006

* cited by examiner

*Primary Examiner*—Anh V La
(74) *Attorney, Agent, or Firm*—Cha & Reiter, LLC

(57) ABSTRACT

Disclosed is a method for implementing an alarm or morning call function in a DMB terminal, including operating a timer to check time information, setting information necessary to implement the alarm or morning call function, including a time preset to output a reserved DMB program and information on the DMB program which will be outputted at the preset time, implementing a DMB function at a time earlier than the preset time by a predetermined time for receiving the reserved DMB program with implementation of the DMB function and outputting the DMB program at the preset time.

19 Claims, 7 Drawing Sheets

METHOD FOR PROVIDING ALARM AND MORNING CALL SERVICES IN A DMB TERMINAL

CLAIM OF PRIORITY

This application claims the benefit of the earlier filing date, pursuant to 35 USC 119, to that patent application entitled "Method for Providing Alarm and Morning Call Services in DMB Terminal," filed with the Korean Intellectual Property Office on Aug. 10, 2005 and assigned Serial No. 2005-73369, the contents of which are incorporated herein by reference.

BACKGROUND OF THE INVENTION

1. Field of the Invention

The present invention relates to a digital multimedia broadcast reservation function in a DMB terminal, and more particularly to a method for providing alarm and morning call services using a digital multimedia broadcast in a DMB terminal.

2. Description of the Related Art

Digital multimedia broadcasting ("DMB") is a mobile broadcasting service that digitally transmits various multimedia signals, such as audio and video signals, to mobile or in-car receivers. DMB is divided into satellite and terrestrial services according to the transmission means. Satellite DMB is a way to broadcast TV programs onto DMB terminals throughout a country using satellite waves. In contrast, terrestrial DMB provides broadcasting services using VHF channels 12 and 8.

Generally, DMB terminals have normal mobile phone functions to enable users to make phone calls while viewing digital broadcasts. As portable devices, DMB terminals will become more integrated to perform various additional functions, such as alarm and morning call functions.

Conventional mobile phones basically have alarm and morning call functions which generate an alarm in a preset manner (specific sound or vibration) when a previously set alarm or morning call time is reached, thereby reminding users of a corresponding schedule or simply waking the users up in the morning.

FIG. 1 is a flow chart showing a process of providing an alarm or morning call service in a conventional mobile phone.

Referring to FIG. 1, a conventional mobile phone operates a timer to confirm time information (step 11) and sets an alarm or a morning call alarm (hereinafter simply referred to as "alarm") as selected by a user (step 12). In order to set an alarm, the user has to set alarm time, alarm sound and activation of the alarm mode.

The mobile phone checks whether the previously set alarm time is reached (step 13). When the alarm time is reached, the mobile phone implements the alarm (or morning call) function by generating the previously set alarm sound (step 14).

FIGS. 2A and 2B are views illustrating a display screen for setting an alarm or morning call function in a conventional mobile phone.

FIG. 2A illustrates the display of a menu for setting an alarm or morning call function in a conventional mobile phone. Although a "morning call" item and an "alarm" item are separately provided under an "e-diary" menu in FIG. 2A, the morning call function is basically similar to the alarm function. The morning call function is different only in that it is implemented everyday, from Monday to Friday, or from Monday to Saturday, according to the user's selection.

FIG. 2B illustrates a mode for inputting details to set the morning call function selected from the menu of FIG. 2A.

As illustrated in FIG. 2B, the mobile phone displays a morning call time ("07:00"), a morning call alarm sound ("clucking sound of a hen"), dates ("Monday to Friday") and activation of the morning call function ("set") as set by the user.

The alarm and morning call functions available in general mobile phones may be applied to the DMB service in a DMB terminal. However, those functions will not be implemented exactly at a preset desired time. In other words, digital multimedia broadcast data, unlike analogue broadcast data, cannot be outputted immediately upon turning-on of a DMB terminal. Accordingly, it is necessary to define a new algorithm for implementing the alarm and morning call functions in consideration of a time of delay which is inevitable due to ensemble scan (in a terrestrial DMB system) and decoding processes.

SUMMARY OF THE INVENTION

Accordingly, the present invention has been made to solve the above-mentioned problems occurring in the prior art and provides additional advantages, by providing a method for implementing an alarm or morning call function using a DMB service in a DMB terminal in consideration of a time of delay in receiving the DMB service.

In one embodiment, there is provided a method for implementing an alarm or morning call function in a DMB terminal, including the steps of operating a timer to check time information, setting information necessary to implement the alarm or morning call function, including a time preset for the reserved output of a DMB program and information on the DMB program which will be outputted at the preset time, implementing a DMB function earlier than the preset time by a predetermined time and receiving the reserved DMB program with implementation of the DMB function and outputting the DMB program at the preset time.

BRIEF DESCRIPTION OF THE DRAWINGS

The above features and advantages of the present invention will be more apparent from the following detailed description taken in conjunction with the accompanying drawings, in which.

DETAILED DESCRIPTION OF THE INVENTION

Hereinafter, embodiments of the present invention will be described with reference to the accompanying drawings. For the purposes of clarity and simplicity, descriptions of well-known functions and constructions are omitted for clarity and conciseness.

DMB is a broadcasting service that receives broadcast data and provides the received data to the users in real time. Accordingly, users can view a broadcast program only at a broadcast time fixed for the program. In addition, unlike a general computer or a notebook, a small-sized DMB terminal has limitations in displaying data for a long time or storing large amounts of data in real time due to its limited memory and battery capacity. For these reasons, it is required to integrate a new function for providing a desired service at an exact time set by the user in a DMB terminal.

The present invention provides a method for implementing an alarm or morning call function in a DMB terminal, which meets the above requirement. The alarm or morning call function can be implemented alone or in connection with a DMB service in a DMB terminal.

Figure 1:
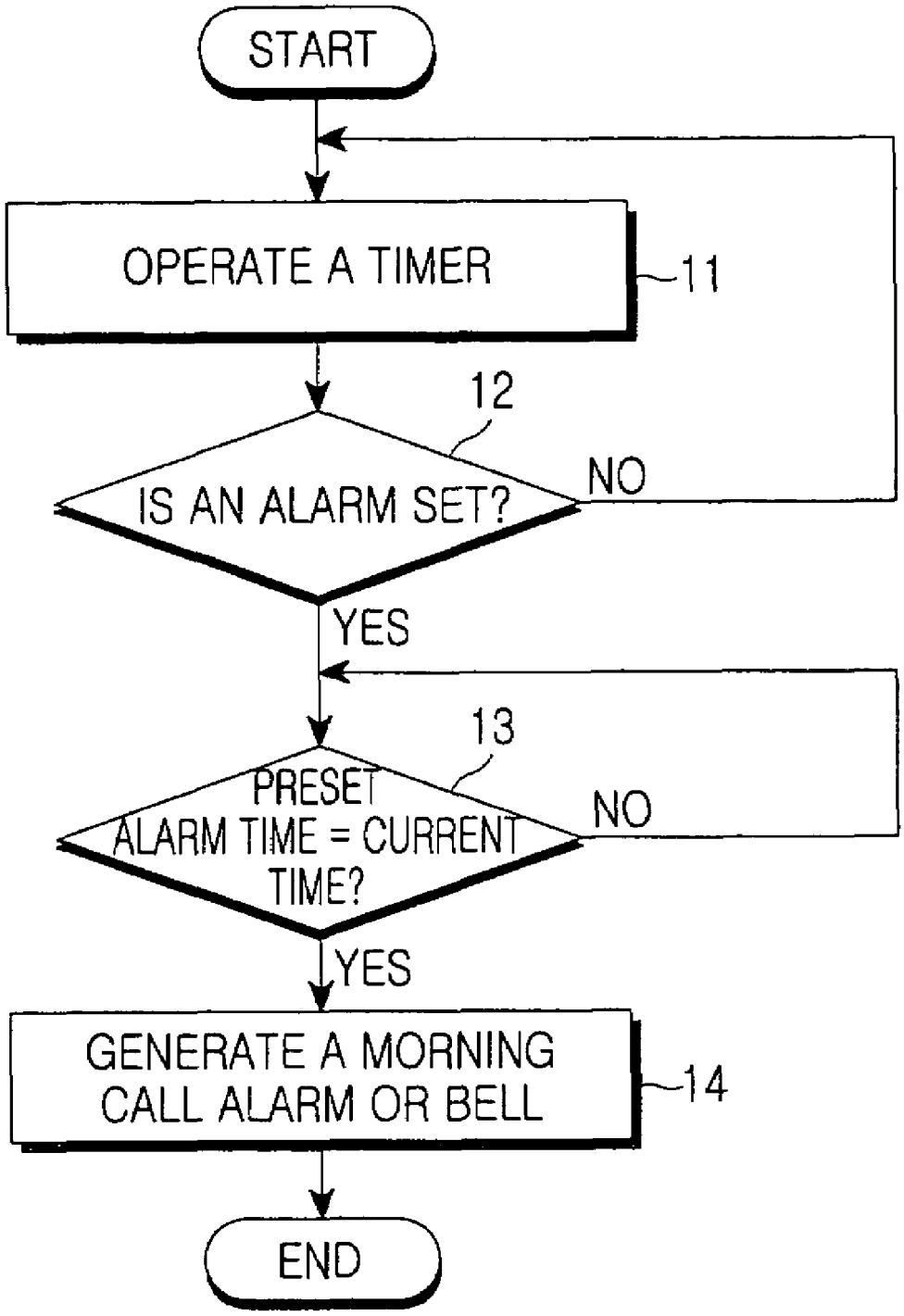
FIG. 1 is a flow chart showing a process of providing an alarm or morning call service in a conventional mobile phone.
Figure 2A:
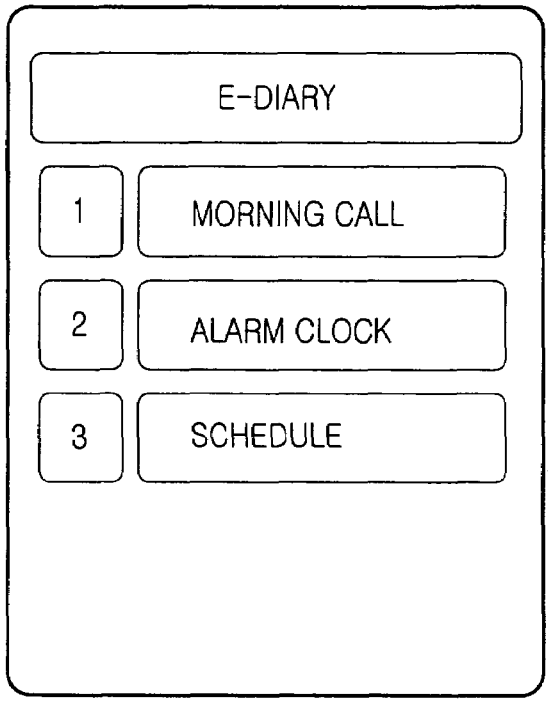
FIGS. 2A and 2B are views illustrating a display screen for setting an alarm or morning call function in a conventional mobile phone.
Figure 2B:
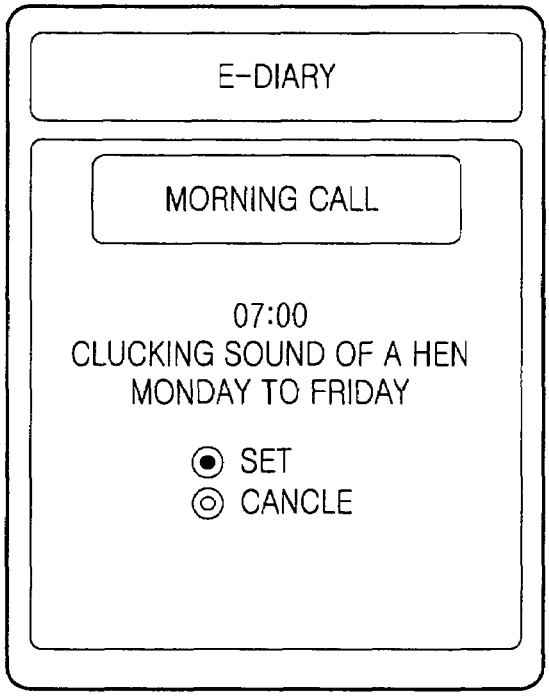
Figure 3:
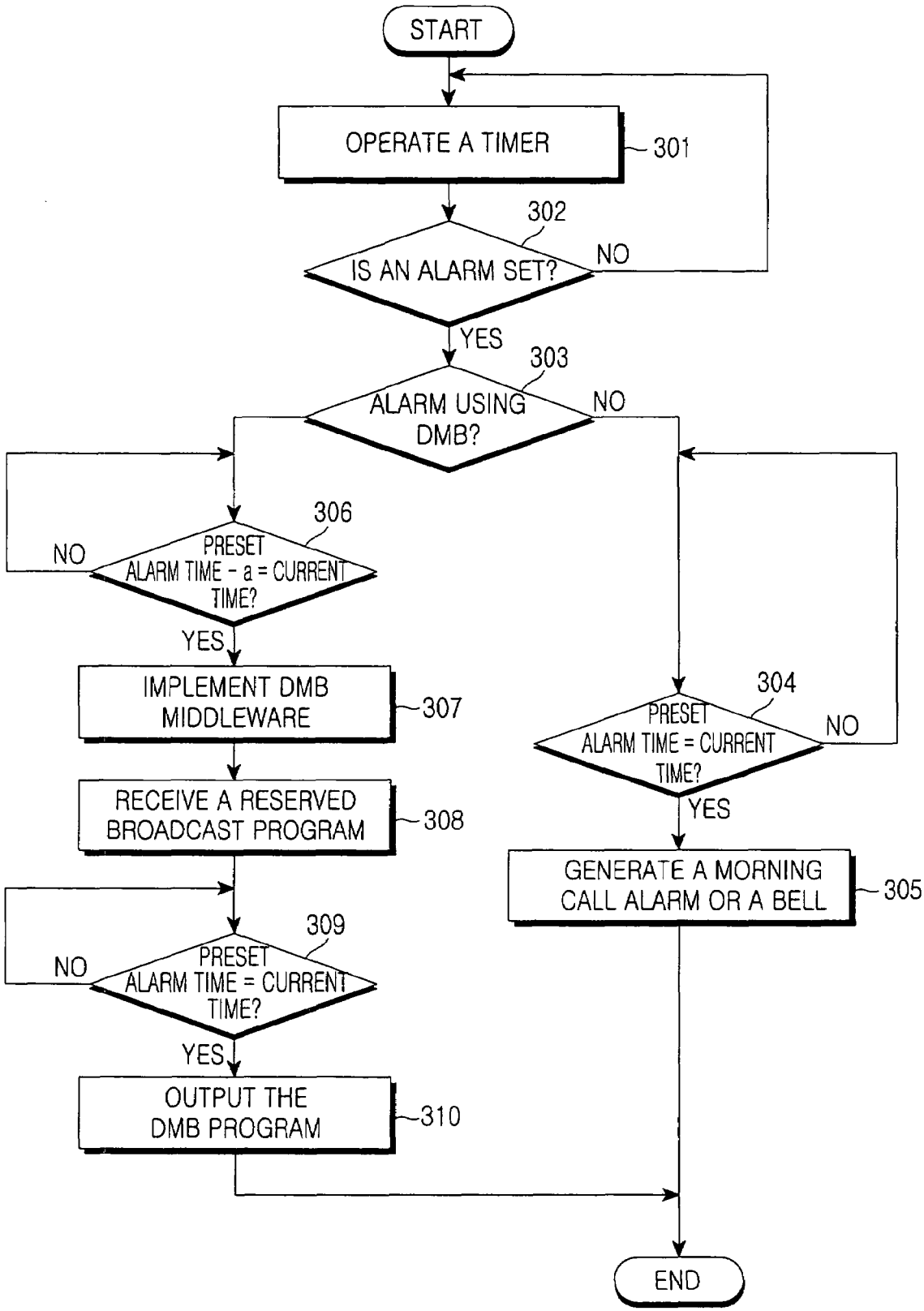
FIG. 3 is a flow chart showing a process of providing an alarm or morning call service in a DMB terminal according to a preferred embodiment of the present invention.

FIG. 3 is a flow chart showing the process of implementing the alarm or morning call service in a DMB terminal according to the present invention.

Referring to FIG. 3, the DMB terminal operates a timer to confirm time information (step 301) and sets an alarm or a morning call alarm (hereinafter simply referred to as "alarm") as selected by a user (step 302). At this time, the alarm can be either a general alarm or a DMB alarm. To set the general alarm, the user has to input information, such as alarm time, alarm sound and activation of the alarm mode. To set the DMB alarm, however, the user has to input information, such as alarm time, service component of a DMB program which will be used as an alarm, and activation of the alarm mode.

When the general alarm not using a DMB service is set (step 303), the DMB terminal confirms whether it is the preset alarm time (step 304). When the alarm time is reached, the DMB terminal implements the alarm (or morning call) function by generating the preset alarm sound (step 305).

On the other hand, when the DMB alarm is set (step 303), the DMB terminal performs an operation for receiving the DMB service earlier than the preset alarm time by a predetermined time a in order to output the preset DMB program exactly at the preset alarm time. The predetermined time a is determined in consideration of the operating time of a DMB middleware, DMB channel search time (for example, ensemble scan time) and time for implementing the received DMB service (for example, decoding time).

The DMB terminal determines whether the current time is "the preset alarm time minus the predetermined time $\alpha$." When the current time is equal to the preset alarm time minus the predetermined time $\alpha$ (step 306), the DMB terminal implements the DMB middleware for the DMB operation (step 307). In a preferred embodiment of the present invention, it is assumed that the predetermined time $\alpha$ is three minutes. The predetermined time a can be reduced with capacity improvement of the DMB system (such as reduction of the ensemble scan time and the decoding time).

The DMB terminal receives the service component of the DMB program which was set in step 302 for use as the alarm time (step 308). Even if the DMB service is received, the DMB terminal will not output the preset DMB program through a display screen or a speaker until the preset alarm time is reached.

The DMB terminal determines whether the current time is equal to the preset alarm time (step 309). When the alarm time is reached, the DMB terminal then outputs the received DMB program (step 310).

Although not depicted in FIG. 3, if the DMB terminal fails to receive the DMB service by the preset alarm time (step 308), it will then return to step 304 and implement the alarm (or morning call) function by generating a typical alarm sound or bell. The failure to receive the DMB service occurs when the user is in a non-service area or if the preset DMB program (service component) is not provided.

FIGS. 4A through 4H represents screen views illustrating a display screen for setting an alarm or morning call function in a DMB terminal according to a preferred embodiment of the present invention.

Figure 4A:
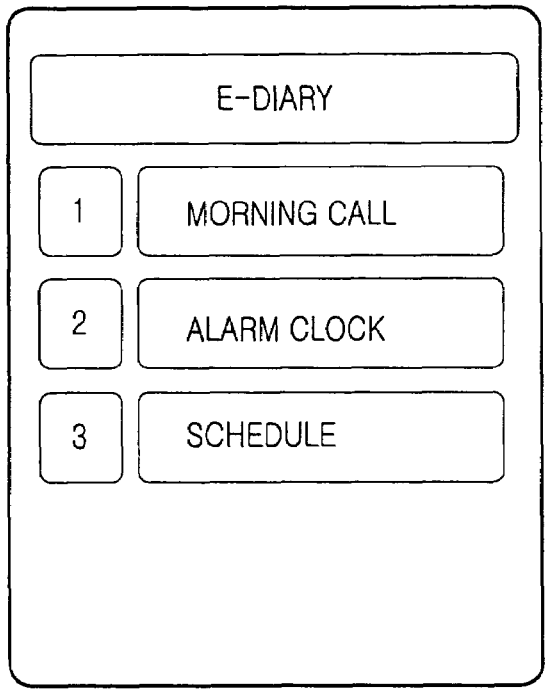
FIGS. 4A through 4H are views illustrating a display screen for setting an alarm or morning call function in a DMB terminal according to a preferred embodiment of the present invention.

FIG. 4A illustrates the display of a menu for setting an alarm or morning call function in a DMB terminal. Although a "morning call" item and an "alarm" item are separately provided under an "e-diary" menu in FIG. 4A, the morning call function is basically similar to the alarm function. The morning call function is different only in that it is implemented everyday, from Monday to Friday, or from Monday to Saturday, according to the user's selection.

Figure 4B:
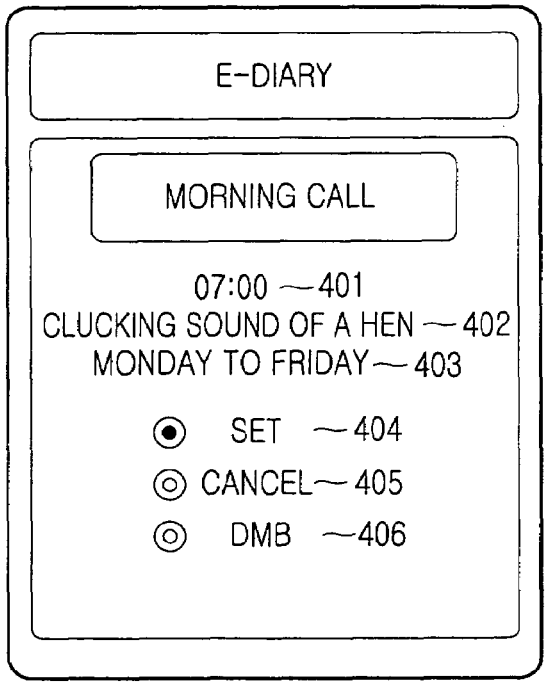

FIG. 4B illustrates a mode for inputting details to set the morning call function selected from the menu of FIG. 4A.

As illustrated in FIG. 4B, the DMB terminal displays a morning call time "07:00" (401), a morning call alarm sound "clucking sound of a hen" (402), dates "Monday to Friday" (403) and activation "set" of the morning call function (404) which have been set by the user. In the mode of FIG. 4B, the user can select "cancel" (405) to cancel the morning call function or "DMB" (406) to implement the morning call function using DMB. "DMB" (406) can be included in the sound information (402) which will be generated as a morning call alarm.

When the morning call alarm time is set to "07:00," the DMB terminal will initiate an operation for receiving the DMB service three minutes earlier, i.e. at 06:57. Even if the preset DMB program is received, the DMB terminal will wait and output the received DMB program only when the alarm time "07:00" is reached.

Figure 4C:
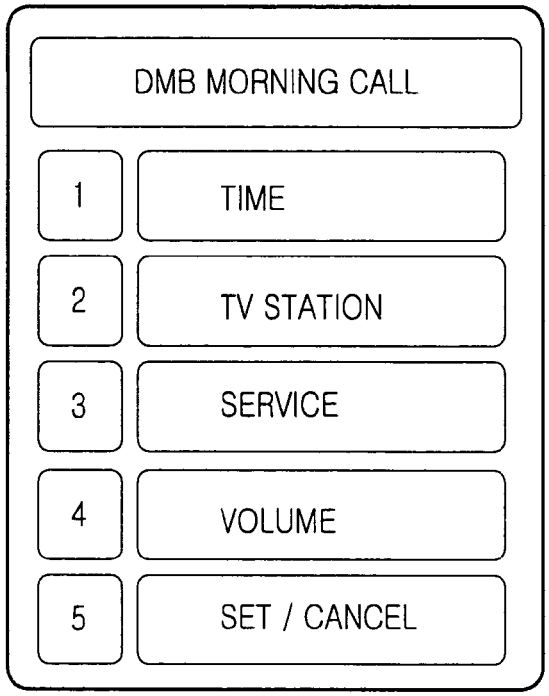

FIG. 4C illustrates the display of a menu for setting a DMB morning call function. As illustrated in FIG. 4C, items "1. time," "2. TV station," "3. service," "4. volume" and "5. set/cancel" are provided under the "DMB morning call" menu. If the morning call time/date and the activation/cancellation of the morning call function are already set in the mode of FIG. 4B, the two items "1. time" and "5. set/cancel" need not be selected.

FIGS. 4D through 4H illustrate sub-menus for selecting the time/date, TV station, service, volume and setting/cancellation of the morning call function.

Figure 4D:
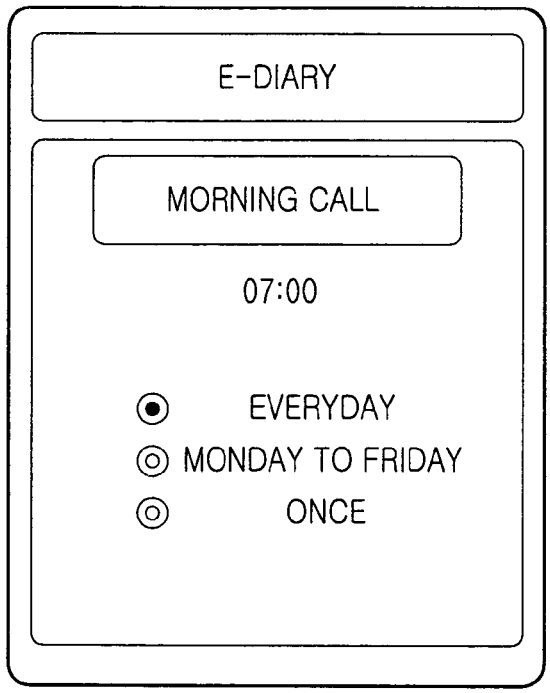

When "1. time" is selected in the menu of FIG. 4C, sub-items, such as morning call alarm time and date (everyday, Monday to Friday or once), are displayed as illustrated in FIG. 4D. For example, "07:00" and "everyday" can be selected as desired morning call alarm time and date.

Figure 4E:
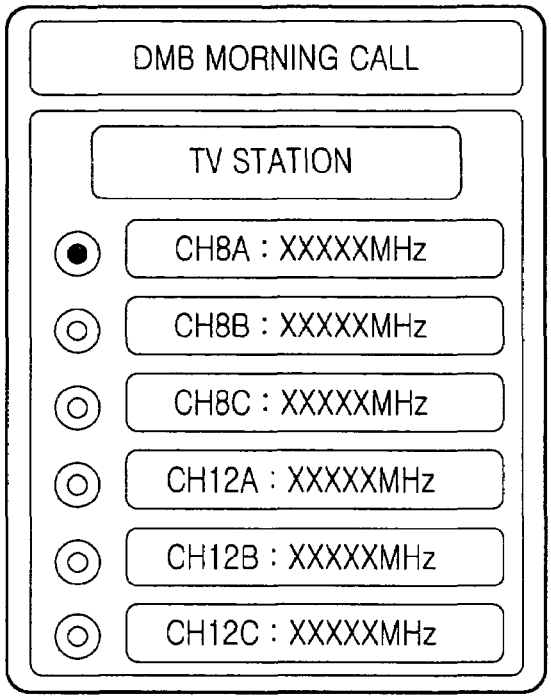

When "2. TV station" is selected in the menu of FIG. 4C, a list of TV stations specified by corresponding channels and frequencies are displayed as illustrated in FIG. 4E. TV stations refer to ensembles in terrestrial DMB or frequencies in satellite DMB.

Figure 4F:
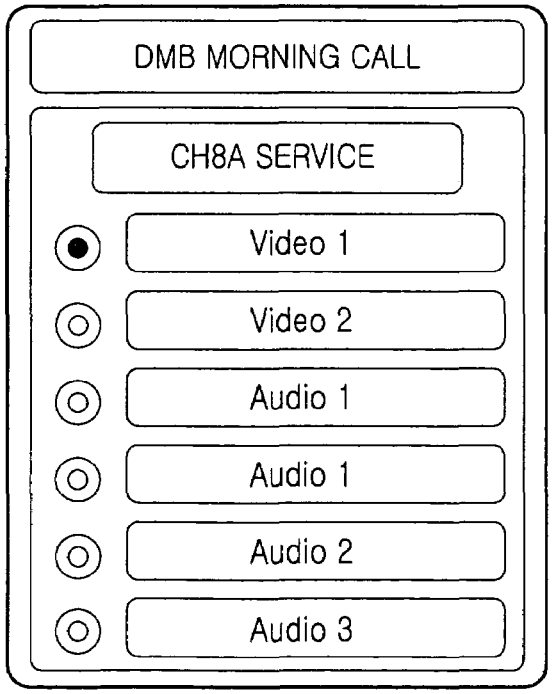

When "3. service" is selected in the menu of FIG. 4C, service components (video service components and audio service components) provided by a TV station selected from the list of FIG. 4E are displayed as illustrated in FIG. 4F. The user can select one of the displayed service components.

In other words, the service components of FIG. 4F will not be displayed if no TV station is selected from the list of FIG. 4E. Accordingly, the two items "2. TV station" and "3. service" are set in relation to each other.

Figure 4G:
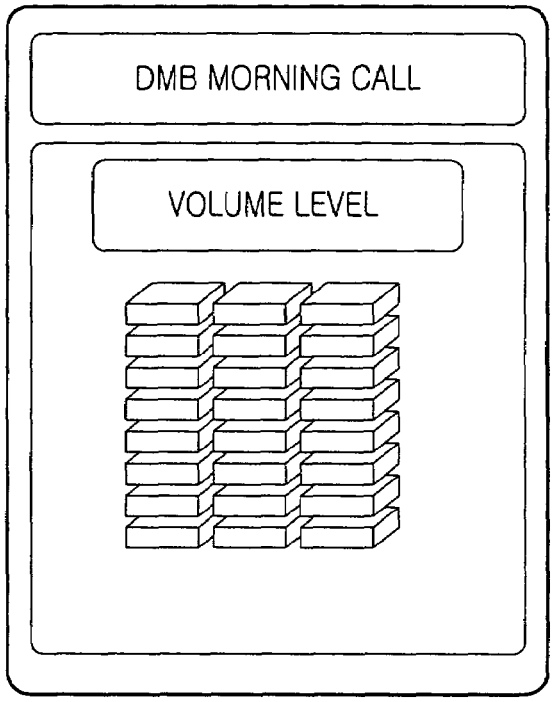

When "4. volume" is selected in the menu of FIG. 4C, a screen view as illustrated in FIG. 4G is displayed. According to a preferred embodiment of the present invention, the user may set a higher volume for the morning call alarm than a general sound volume for enjoying a DMB service. Since the morning call alarm is aimed to wake up the user or inform the user of the time, rather than to simply provide the DMB service, it should preferably be generated at a higher-level volume.

Figure 4H:
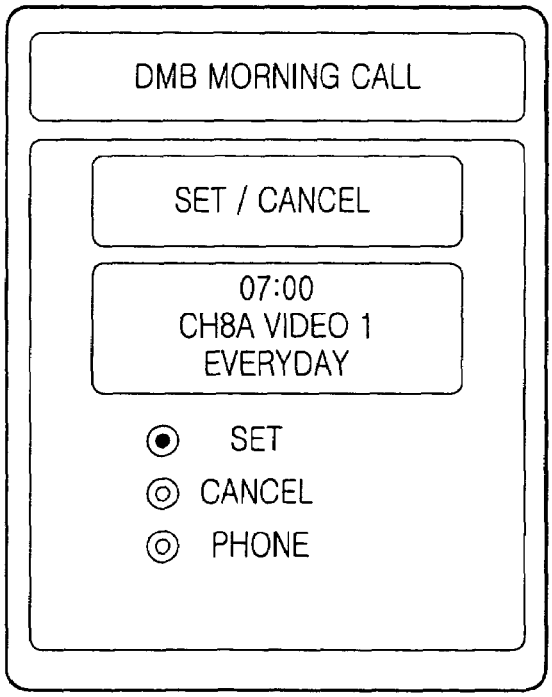

When "5. set/cancel" is selected in the menu of FIG. 4C, a screen view as illustrated in FIG. 4H is displayed so that the user can set or cancel all the previous selections (such as time/date, TV station, service and volume) for the morning call alarm in the DMB mode. At this time, it is also possible to change the mode from the DMB morning call alarm to the general morning call alarm.

As explained above, the morning call function using a DMB service is similar to the DMB reservation function.

However, the DMB reservation function is implemented only once and cancelled automatically after a reserved DMB service is provided.

Users can set the DMB reservation function using EPG information while viewing a DMB program. During the EPG information search, the users can move a curser (or a focus) on a program desired to be reserved for viewing and set or cancel the reservation of the selected program using a specific key (for example, * or # key) provided on a DMB terminal.

For the viewing reservation of the selected program, the start time of the selected program should be set through a process similar to that of FIG. 3. In other words, when a DMB reservation is set in a manner similar to the alarm setting of step 302, the DMB terminal proceeds to step 306 and determines whether the current time is equal to the preset reservation time minus the predetermined time $\alpha$. Subsequent operations for the viewing reservation of the selected program are similar to those for implementing the alarm function.

The method for implementing the alarm or morning call function using a DMB service according to the present invention can be stored in a computer-readable form in a recording medium (such as a CD ROM, RAM, floppy disk, hard disk or magneto-optical disk). It would be recognized that the terminal may include a processor that receives and executes the computer program or a computer-executable code, which may be stored in a memory.

In accordance with the present invention, when the alarm (or morning call) function using a DMB service is set, an operation for receiving the DMB service is implemented earlier than a preset alarm time in consideration of a delay time inevitable in a DMB terminal, thereby implementing the alarm function exactly at the preset alarm time.

Since a DMB service can be used as an alarm or a morning call alarm, the DMB terminal can inform the user that it is the alarm time by outputting a previously selected broadcast program.

Since a DMB service can be used as an alarm or a morning call alarm, the DMB terminal enables the user to view a desired broadcast program exactly at a preset alarm time.

Although preferred embodiments of the present invention have been described for illustrative purposes, those skilled in the art will appreciate that various modifications, additions and substitutions are possible, without departing from the scope and spirit of the invention as disclosed in the accompanying claims, including the full scope of equivalents thereof.

What is claimed is:

1. A method for implementing an alarm or morning call function in a Digital Multimedia Broadcasting (DMB) terminal, comprising the steps of:

operating a timer to check time information;

setting DMB service information necessary to provide DMB service at a preset alarm time;

executing a DMB function for receiving a DMB program at a time earlier than the preset alarm time using the DMB service information; and outputting on a display the received DMB program at the present alarm time.

2. The method according to claim 1, wherein said DMB service information necessary to provide DMB service at a preset alarm time includes:

DMB station information specifying the reserved DMB program;

DMB service information specifying a service component of a corresponding DMB station according to the DMB station information; and volume information specifying a volume level of the reserved DMB program which will be outputted.

3. The method according to claim 1, further comprises the step of:

waiting, without outputting the received DMB program, until the preset alarm time is reached.

4. The method according to claim 1, wherein further comprises the step of:

generating an alarm or a morning call alarm using any other output function than the DMB function at the preset alarm time, if the reserved DMB program is not received.

5. The method according to claim 4, wherein said other output function is a ring sound of the DMB terminal.

6. A Digital Multimedia Broadcasting (DMB) terminal incorporating an alarm function, the terminal comprising:

a memory containing computer-executable code; and a processor in communication with the memory, the computer-executable code providing instruction to the processor for executing the steps of:

operating a timer to check time information;

setting DMB service information necessary to provide DMB service at a preset alarm time;

executing a DMB function for receiving a DMB program at a time earlier than the preset alarm time using the DMB service information; and outputting the received DMB program at the preset alarm time.

7. The terminal according to claim 6, wherein said DMB service information necessary to provide DMB service at a preset alarm time includes:

DMB station information specifying the reserved DMB program;

DMB service information specifying a service component of a corresponding DMB station according to the DMB station information; and volume information specifying a volume level of the reserved DMB program which will be outputted.

8. The terminal according to claim 6, the code providing further instruction to the processor for executing the step of:

waiting, without outputting the received DMB program, until the preset alarm time is reached.

9. The terminal according to claim 6, the code providing further instruction to the processor for executing the step of:

generating an alarm or a morning call alarm using any other output function than the DMB function at the preset alarm time, if the reserved DMB program is not received.

10. The terminal according to claim 9, wherein said other output function is a ring sound of the DMB terminal.

11. The terminal according to claim 6, further comprising:

a display for outputting the received DMB program.

12. The terminal according to claim 11, wherein the code providing further instruction to the processor for executing the step of:

receiving input information from the display.

13. The terminal according to claim 6, wherein the time earlier than the preset alarm time is selected based on the operating time of a DMB middleware, a DMB channel search time and a time for executing the received DMB service.

14. The method according to claim 1, wherein the at a time earlier than the preset alarm time is selected based on the operating time of a DMB middleware, a DMB channel search time and a time for executing the received DMB service.

15. An alarm generating Digital Multimedia Broadcasting (DMB) terminal comprising:

means for monitoring and comparing a current time to a preset alarm time;

means for executing a DMB function at a time earlier than the preset alarm time using DMB service information necessary to provide DMB service at preset alarm time, the DMB function for receiving a DMB program; and means for generating the alarm at the preset alarm time.

16. The terminal according to claim 15, wherein the time earlier than the preset alarm time is selected based on the operating time of a DMB middleware, a DMB channel search time and a time for executing the received DMB service.

17. The terminal according to claim 15, further comprising:

means for receiving input information associated with the preset alarm time.

18. The terminal according to claim 17, wherein the information associated with the preset alarm time is selected from the group consisting of: DMB station information; DMB service information specifying a service component of a corresponding DMB station, and volume information.

19. The terminal according to claim 15, wherein the alarm is selected from the group consisting of: received DMB program and a ring sound.

* * * * *